US006493903B1

(12) United States Patent
Super

(10) Patent No.: US 6,493,903 B1
(45) Date of Patent: Dec. 17, 2002

(54) HAND-HELD VACUUM CLEANER WITH HEADLAMP

(75) Inventor: Orion J. Super, Sunny Isles, FL (US)

(73) Assignee: Quest Industries, Inc., Miami, FL (US)

( * ) Notice: Subject to any disclaimer, the term of this patent is extended or adjusted under 35 U.S.C. 154(b) by 0 days.

(21) Appl. No.: 09/859,630

(22) Filed: May 18, 2001

(51) Int. Cl.[7] ..... A47L 9/00
(52) U.S. Cl. ..... 15/324; 15/344
(58) Field of Search ..... 15/324, 344

(56) References Cited

U.S. PATENT DOCUMENTS

| | | | | | |
|---|---|---|---|---|---|
| 2,484,491 | A | * | 10/1949 | Daugherty | 15/324 |
| 3,679,885 | A | * | 7/1972 | Selley et al. | 15/324 |
| 4,209,870 | A | * | 7/1980 | Doyel | 15/344 |
| D259,618 | S | | 6/1981 | Tack | |
| 4,656,687 | A | * | 4/1987 | Wei | 15/324 |
| 4,791,700 | A | * | 12/1988 | Bigley et al. | 15/324 |
| 4,829,625 | A | * | 5/1989 | Wang | 15/344 |
| 4,993,106 | A | * | 2/1991 | Hult et al. | 15/344 |
| 5,107,565 | A | * | 4/1992 | Chun | 15/324 |
| 5,207,498 | A | | 5/1993 | Lawrence et al. | |
| 5,983,443 | A | | 11/1999 | Redding | |
| 5,987,697 | A | | 11/1999 | Song et al. | |
| 6,360,399 | B1 | * | 3/2002 | Vandenbelt et al. | 15/324 |

* cited by examiner

*Primary Examiner*—Theresa T. Snider
(74) *Attorney, Agent, or Firm*—Alvin S. Blum

(57) ABSTRACT

A hand held, battery powered vacuum cleaner has a sealed light compartment over the vacuum opening with a lens that directs a light beam onto the plane of the surface being cleaned at least as close to the nozzle as one inch. The light chamber is smoothly integrated into the top of the nozzle so that the nozzle may illuminate and clean in spaces having low vertical clearance.

10 Claims, 2 Drawing Sheets

HAND-HELD VACUUM CLEANER WITH HEADLAMP

FIELD OF THE INVENTION

This invention relates to cordless vacuum cleaners, and more particularly to a light in the detachable nozzle of such a hand-held vacuum cleaner that illuminates an area directly forward of the nozzle.

BACKGROUND OF THE INVENTION

U.S. Pat. No. 5,207,498 issued May. 4, 1993 to Lawrence teaches a vacuum cleaner with a lamp located well back of the nozzle opening, using a fan shape light pipe to direct the light forward and out a broad, front aperture to reduce the height of the front end of the cleaner. U.S. Pat. Des. No. 259,618 issued Jan. 23, 1981 to Tack, and U.S. Pat. No. 5,983,443 disclose a hand-held vacuum cleaner with a headlight well behind the nozzle opening. U.S. Pat. No. 5,987,697 issued Nov. 23, 1999 to Song teaches a wide lamp housed in a chamber lined with reflective material to disperse the light into a wide flat beam. The lamp is within the airflow path to cool the lamp.

SUMMARY OF THE INVENTION

It is accordingly an object of the invention to provide a hand held, battery or cigarette lighter powered vacuum cleaner having a headlamp in an isolated compartment over the nozzle that illuminates an area directly forward of the surface being cleaned by the nozzle. It is another object that the isolated compartment be closed at its forward end by a lens to direct the emitted light. It is yet another object that the overall height of the forward portion of the cleaner be low so as to enable it to be used under items that have little vertical clearance such as beneath automobile seats. It is yet another object that these items not block the light. This is achieved by having the lens in a straight line with the downwardly sloping top to direct the light down onto the plane of the nozzle opening as close to one inch forward of the nozzle.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 2:
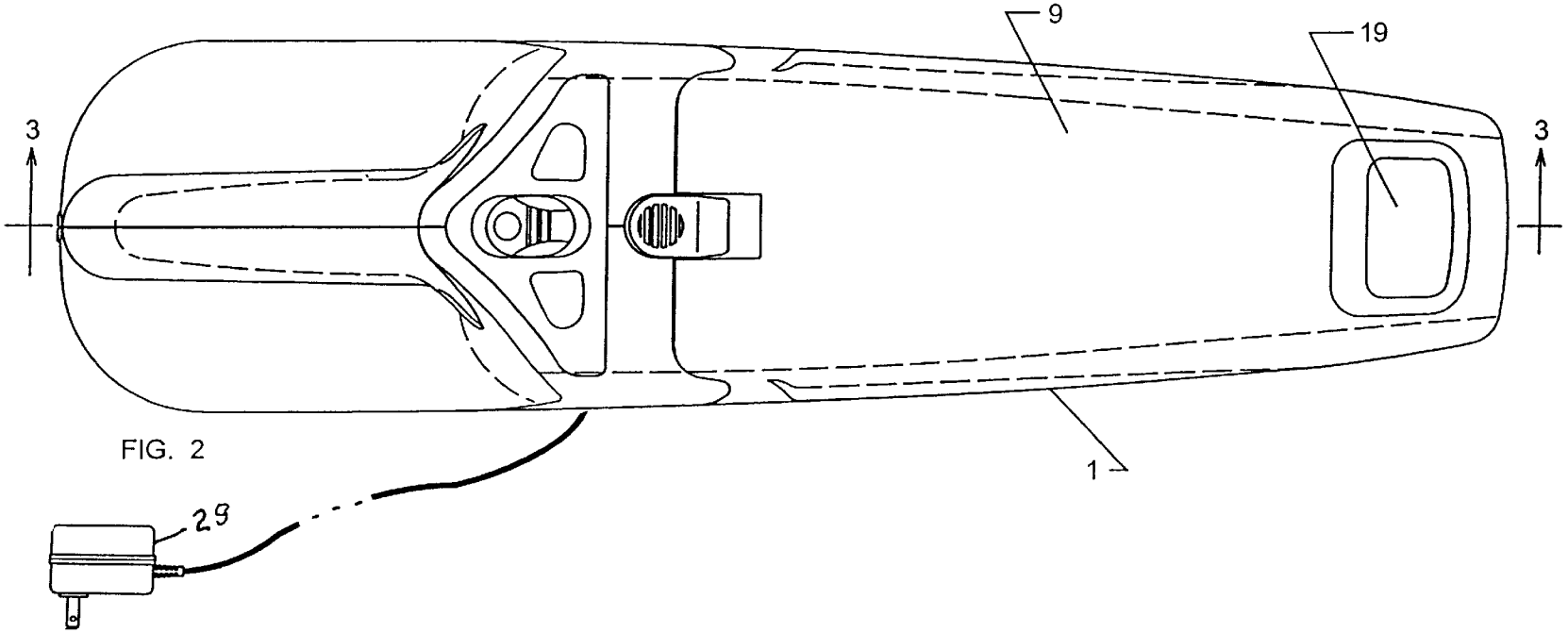
FIG. 2 is a top view of invention.
Figure 1:
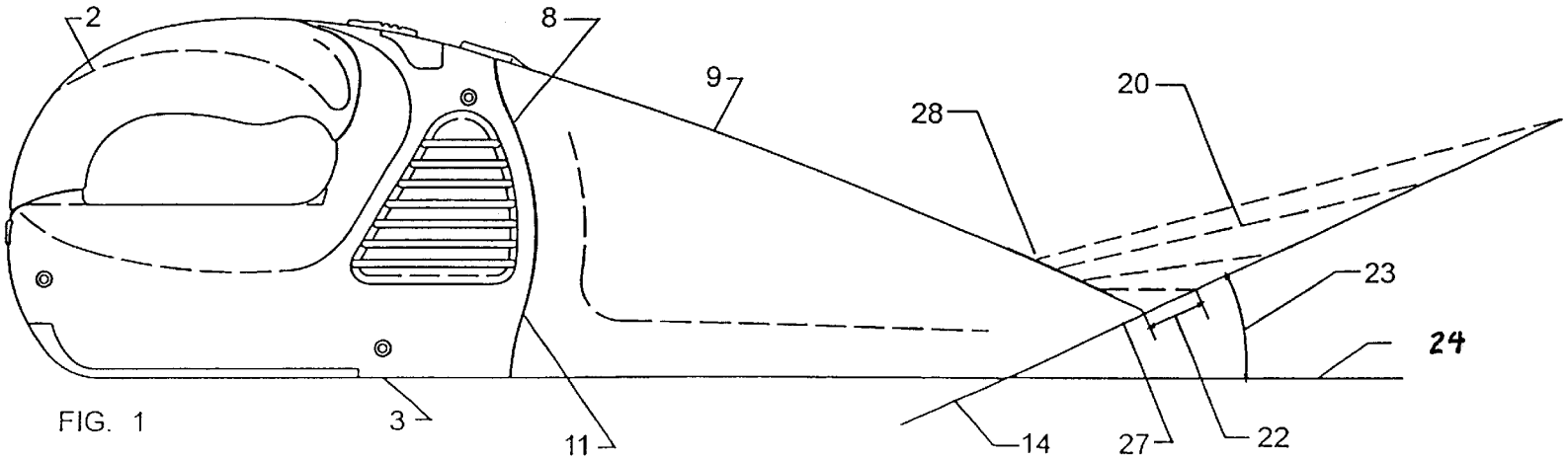
FIG. 1 is a side elevation view of the vacuum cleaner of the invention.
Figure 4:
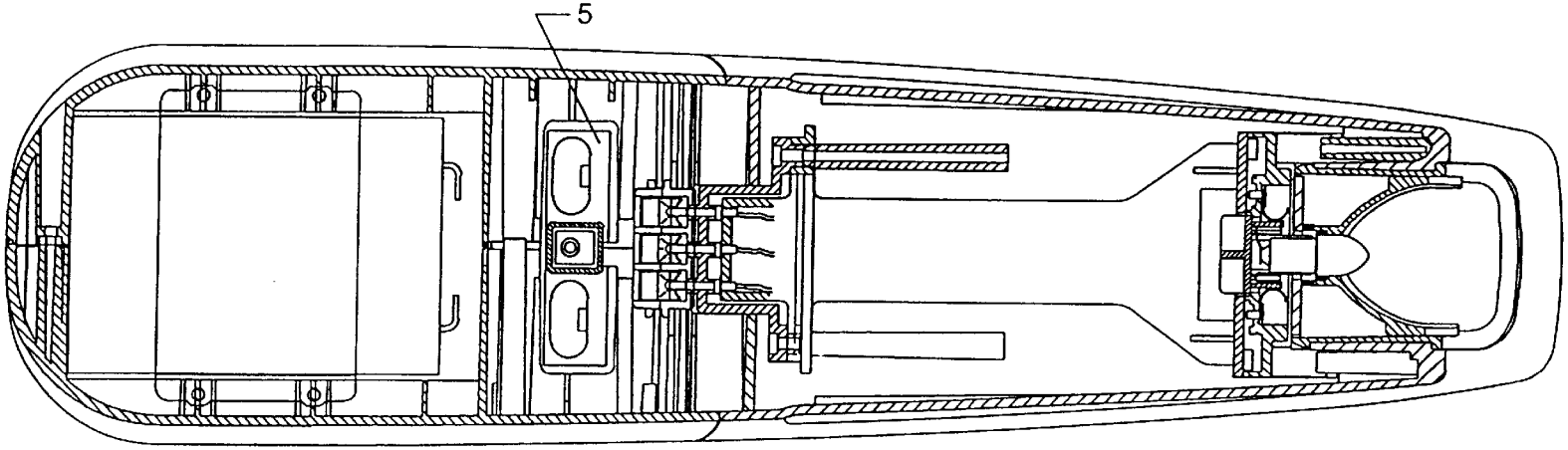
FIG. 4 is a sectional view taken through line 4—4 of FIG. 3.
Figure 3:
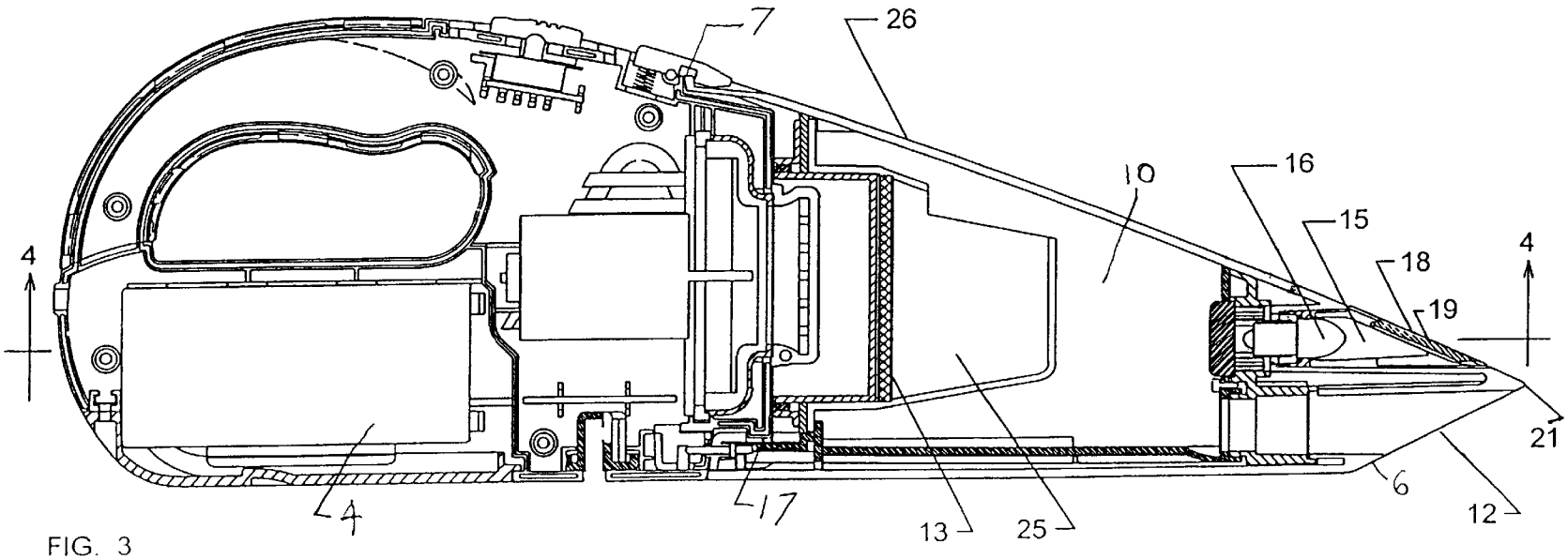
FIG. 3 is a sectional view taken through line 3—3 of FIG. 2.

Referring now to the drawing figures, the hand held, battery powered vacuum cleaner 1 of the invention has a rear compartment 3 of conventional design. It has a handle 2, a rechargeable battery 4, and a battery powered motor/fan suction assembly 5. Alternatively, the vacuum cleaner has no internal battery, and power is drawn from the vehicle battery by the wire and plug 29 that plugs into the cigarette lighter outlet. A nozzle assembly 9 of the invention comprises a vacuum chamber 10 having a rear opening 11 that connects by hermetically sealing connecting means 7 to the opening 8 in the rear compartment 3. The chamber 10 has a forward opening 12 in communication with the rear opening 11 so that a vacuum is applied to the opening 12 which has a perimeter 6 lying in a perimeter plane 14 that is applied to a surface to be cleaned. Vacuum cleaner 1 has a substantially flat bottom lying in a bottom plane 24. The perimeter plane 14 intersects the bottom plane 24 at an angle 23 of between 15 and 35 degrees preferably between 22 and 26 degrees. The angle 23 of 24 degrees has been found to be useful for cleaning under vehicle seats. A filter 13 across the rear opening 11 holds debris picked up through opening 12 within debris collecting compartment 25 in vacuum chamber 10. An upper closed light chamber 15 contains a DC electric powered light emitter 16 connected to the battery by connecting means 17. The emitter may be any of the emitters known in the art. The forward end 18 of the light chamber 15 is closed by a plain or Fresnel lens 19 that directs the light beam 20 down onto the perimeter plane 14 such that the plane is illuminated at a distance 22 that is least as close as one inch from the forward edge 21 of the nozzle. The upper surface of the light chamber is substantially in a straight line with the upper smoothly sloping surface 26 of the nozzle. This configuration makes it possible for the area directly in front of the nozzle to be illuminated during cleaning even when cleaning under items that have very little clearance. The distance between the front edge 27 of the forward opening and the top 28 of the Fresnel lens is not more than 3 inches, referably is less than 2 inches to enable the nozzle to reach into confined spaces.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A vacuum cleaner having a battery powered suction assembly in a rear compartment, and a nozzle assembly, the nozzle assembly comprising:

a) a vacuum chamber having a rear opening and a forward opening;

b) releasable connecting means at the rear opening for hermetic sealing to the rear compartment for transmission of vacuum created in the rear compartment to the vacuum chamber;

c) filter means across the rear opening for retaining debris within the vacuum chamber;

d) the forward opening having a perimeter lying in a plane for application to a surface to be cleaned;

e) an upper, closed light chamber containing an electric powered light emitter positioned above the forward opening of the vacuum chamber and a light opening that is closed by a transparent lens, the lens and emitter constructed for shining the light emitted upon said surface at least as close as one inch from a forward edge of the nozzle assembly; and f) electrical connecting means for correcting the rear compartment and the emitter for energizing the emitter.

2. A vacuum cleaner having a battery and a battery powered suction assembly in a rear compartment, and a nozzle assembly, the nozzle assembly comprising:

a) a housing having a substantially flat bottom lying in a bottom plane, a sloping top portion sloping down to a forward portion in a substantially straight line, the forward portion connecting the top portion to a bottom portion and provided with a forward opening whose perimeter lies in a plane that intersects the bottom plane at an acute angle, the forward opening for application to a surface to be cleaned;

b) a vacuum chamber within the housing having a rear opening in communication with the forward opening;

c) releasable connecting means at the rear opening for hermetic sealing to the rear compartment for transmission of vacuum created in the rear compartment to the vacuum chamber;

d) filter means across the rear opening for retaining debris within the vacuum chamber;

e) a closed light chamber having a top that is flush with the top portion, the light chamber containing an electric powered light emitter positioned above the forward opening, the light chamber having a light opening that is closed by a transparent lens that is directly above the forward opening, the lens and emitter constructed for shining the light emitted upon said surface at least as close as one inch from a forward edge of the nozzle assembly; and f) first electrical connecting means for connecting the rear compartment and the emitter for energizing the emitter.

3. The vacuum cleaner according to claim 2, in which the distance between the forward edge of the nozzle assembly and the top of the lens is not more than 3 inches to enable cleaning in confined spaces.

4. The vacuum cleaner according to claim 3, in which the acute angle is between 15 and 35 degrees.

5. The vacuum cleaner according to claim 2, in which the acute angle is between 15 and 35 degrees.

6. The vacuum cleaner according to claim 3, in which the acute angle is between 22 and 26 degrees.

7. The vacuum cleaner according to claim 2, in which the acute angle is between 22 and 26 degrees.

8. The vacuum cleaner according to claim 2, in which the lens is a Fresnel lens.

9. The vacuum cleaner according to claim 2, further comprising a second electrical connecting means for connecting the rear compartment and a socket for a cigarette lighter in a vehicle.

10. A vacuum cleaner having a battery and a battery powered suction assembly in a rear compartment, and a nozzle assembly, the nozzle assembly comprising:

a) a housing having a substantially flat bottom lying in a bottom plane, a sloping top portion sloping down to a forward portion in a substantially straight line, the forward portion connecting the top portion to a bottom portion and provided with a forward opening whose perimeter lies in a plane that intersects the bottom plane at an acute angle, the forward opening for application to a surface to be cleaned;

b) a vacuum chamber within the housing having a rear opening in communication with the forward opening;

c) releasable connecting means at the rear opening for hermetic sealing to the rear compartment for transmission of vacuum created in the rear compartment to the vacuum chamber;

d) filter means across the rear opening for retaining debris within the vacuum chamber;

e) a closed light chamber containing an electric powered light emitter positioned above the forward opening, the light chamber having a light opening that is closed by a Fresnel lens that is directly above the forward opening, the lens and emitter constructed for shining the light emitted upon said surface at least as close as one inch from a forward edge of the nozzle assembly; and f) electrical connecting means for connecting the rear compartment and the emitter for energizing the emitter.

* * * * *